United States Patent [19]

Crespi

[11] 4,178,975

[45] Dec. 18, 1979

[54] DISPENSING DEVICE ACTUATED BY A RECEIVING MEMBER

[76] Inventor: Carlo Crespi, Via Bertinoro, 9, Milano, Italy

[21] Appl. No.: 843,109

[22] Filed: Oct. 18, 1977

[30] Foreign Application Priority Data

Aug. 30, 1977 [IT] Italy ..... 27080 A/77

[51] Int. Cl.[2] ..... B65D 35/40; B65D 35/56

[52] U.S. Cl. ..... 141/362; 222/105; 222/207; 417/476

[58] Field of Search ..... 222/105, 207, 209, 94, 222/95; 141/360, 362; 417/474, 476, 478, 479; 251/6

[56] References Cited

U.S. PATENT DOCUMENTS

| | | | |
|---|---|---|---|
| 2,113,022 | 4/1938 | Hefti | 251/6 X |
| 2,609,122 | 9/1952 | Stenerson | 222/105 |
| 2,792,856 | 5/1957 | Coppage | 141/362 |
| 3,211,340 | 10/1965 | Zander et al. | 222/105 X |
| 3,223,289 | 12/1965 | Bouet | 222/95 X |

*Primary Examiner*—F. J. Bartuska

*Attorney, Agent, or Firm*—Guido Modiano; Albert Josif; Lazar D. Wechsler

[57] ABSTRACT

A dispensing device for toothpaste or other paste-like material, comprising an elastically deformable duct arranged within a housing and connected at one end to a container of the material to be dispensed and at the other end to a delivery mouth. Parallel to the duct there is movable a carriage having a member capable of engaging the duct to squeeze it in a given direction, thus causing dispensing of a controlled amount of the material contained in the duct, while simultaneously sucking up therein a substantially equal amount of material. The carriage is operable by a toothbrush or other receiving member which is insertable into the housing below the delivery mouth. The material is dispensed directly on the bristles of the toothbrush or other receiving member while the same travels below the delivery mouth during return of the carriage and toothbrush under the action of a return spring.

3 Claims, 10 Drawing Figures

DISPENSING DEVICE ACTUATED BY A RECEIVING MEMBER

BACKGROUND OF THE INVENTION

This invention relates to a dispensing device for toothpaste or other paste-like materials.

It is well known that one of the drawbacks more likely to occur in using a toothpaste is that the cap of the toothpaste tube, upon unscrewing it out of the tube, is dropped on the floor or in the sink or washbasin. When this occurs, the cap may easily get contaminated with dirt, thereby it has to be carefully cleaned before threading it back onto the tube. In the event of the cap falling into the sink or wash basin it also becomes possible for it to end in the drain pipe and restrict it, such that it is difficult to remove the cap therefrom without the assistance of an expert equipped with proper tooling. Even the threading of the cap onto the tube may pose some difficulties, and cause the same kind of inconvenience.

Another problem encountered in using toothpaste is the difficulty of exactly metering the amount of paste onto the toothbrush; it being clear that while an excessive amount thereof causes waste of toothpaste, an insufficient amount requires the tube to be squeezed once more, to create further metering problems.

SUMMARY OF THE INVENTION

In order to obviate such drawbacks, this invention is directed to providing an automatic dispensing device, which affords a uniform and controlled distribution of toothpaste or other paste-like material onto a toothbrush or the like, without requiring any manual action on the tube or other paste container.

It is another object of the invention to provide a dispensing device which ensures improved hygienics, not only in handling the toothpaste but also in handling the brush whereon the paste is to be distributed.

It is a further object of this invention to provide an automatic dispensing device of extremely limited cost, simple construction, and useful with any type of tooth cleaning paste or possibly incorporating such a toothpaste.

These and other objects, such as will be apparent from the detailed description which follows, are achieved by a dispensing device for toothpaste or other paste-like material, characterized in that it comprises a tube or other container of said toothpaste or material and a delivery mouth effective to deliver a controlled amount of said toothpaste or material on a toothbrush or the like, between said container or tube and said delivery mouth there intervening an elastically deformable duct, and means being provided operable by said toothbrush or the like to gradually compress said duct in the delivery direction to deliver a controlled amount of said toothpaste or material onto said toothbrush or the like, while simultaneously sucking up a substantially equal amount into said duct.

BRIEF DESCRIPTION OF THE DRAWINGS

Further features and advantages of the invention will become more apparent from the ensueing detailed description of a preferred but not exclusive embodiment of the invention, given herein for example purposes only and illustrated in the accompanying drawings, where.

DESCRIPTION OF THE PREFERRED EMBODIMENTS

Figure 1:
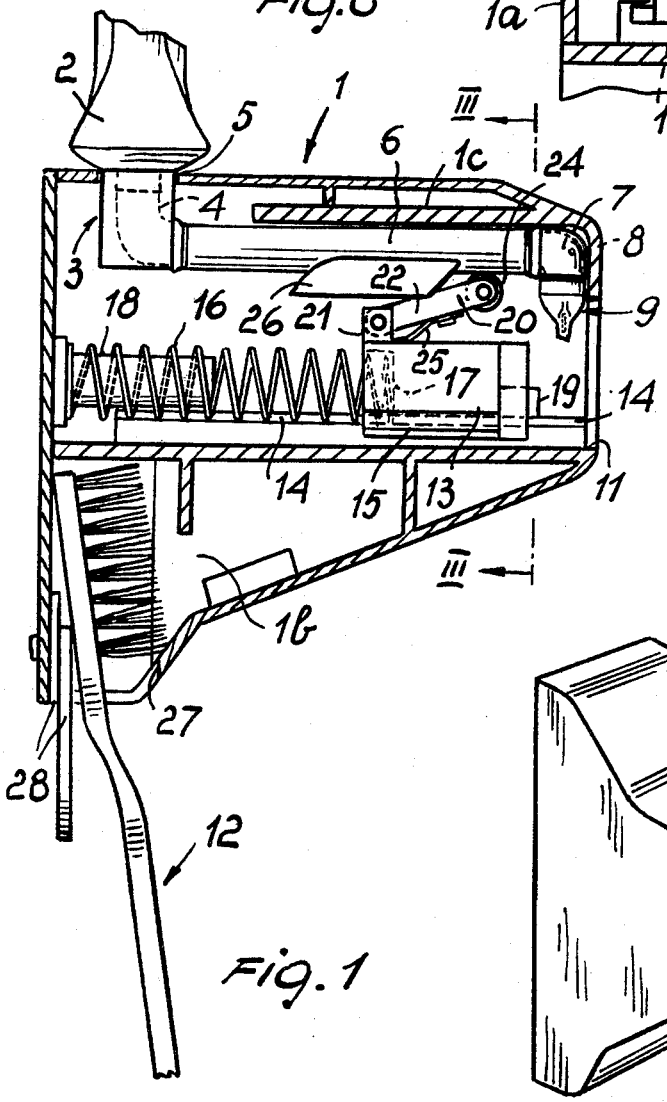
FIG. 1 shows, partly in section, a first embodiment of a dispensing device according to the invention.
Figure 2:
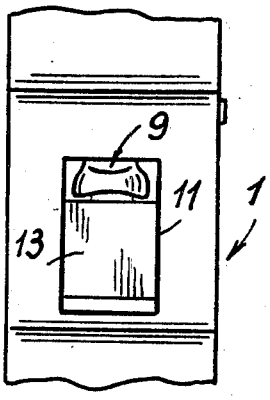
FIG. 2 is a partial front view of the device of FIG. 1.
Figure 7:
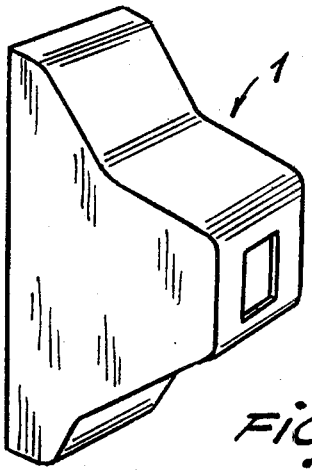
FIG. 7 shows in perspective view another embodiment of the inventive device.

Making reference in particular to FIG. 1 of the drawings, the dispensing device for toothpaste or other paste-like material comprises a protective enclosure or housing 1, to the top portion whereof is attached a tube 2 containing a toothpaste or other paste-like material. The tube 2 extends advantageously upwards, although this is no strict requirement of the invention, and has its bottom portion, wherefrom the paste flows out, connected in sealing engagement with a block 3 attached to the enclosure 1 and provided with an inner passage 4 shown in dotted lines. Communication between the tube 2 and block 3 is provided by an opening 5 through the enclosure 1, and may be either a threaded connection or press-fit connection, or connection of any other suitable type. The tube 2 can thus be easily replaced. However, the tube could also be entirely contained within the enclosure 1 (FIG. 7).

Figure 4:
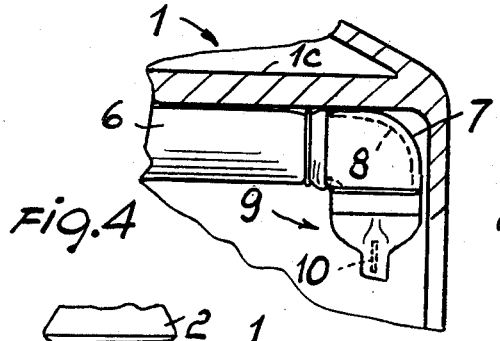
FIGS. 4 and 5 show, on an enlarged scale, details of the delivery mouth, respectively in side and front elevations.
Figure 5:
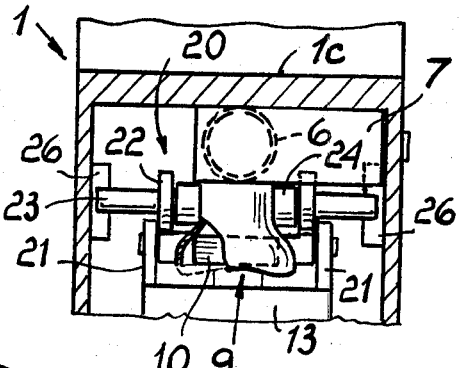
Figure 6A:
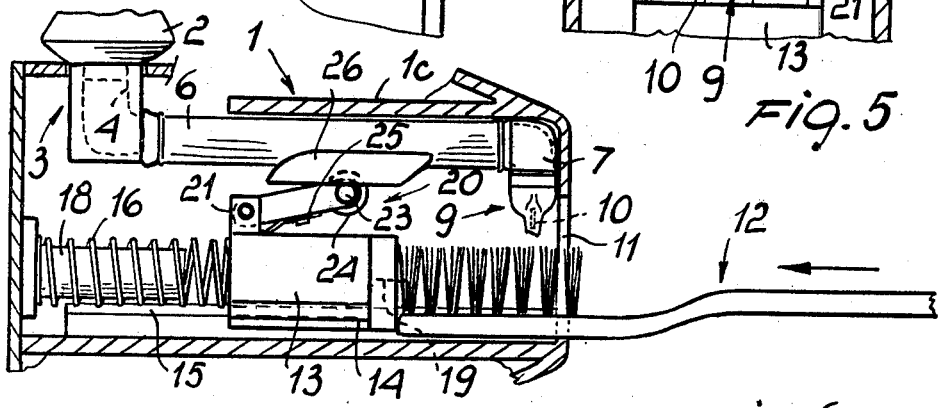
FIGS. 6*a*, 6*b*, and 6*c* show three successive steps of operation of the device of FIG. 1.
Figure 6B:
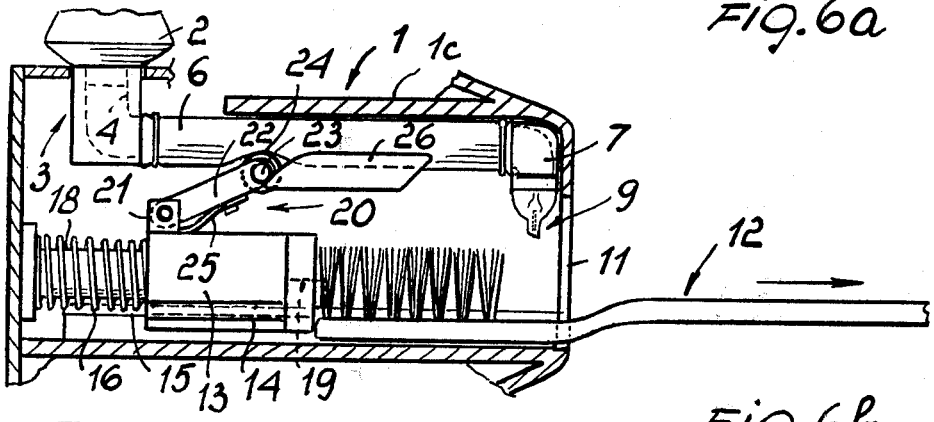
Figure 6C:
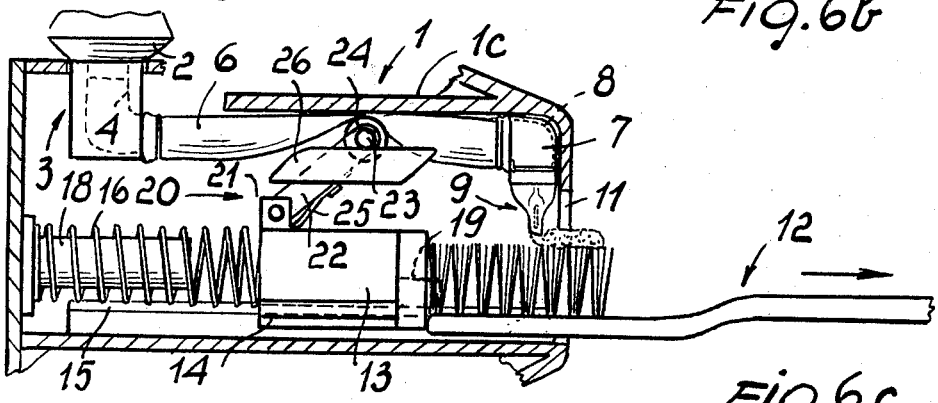

Downstream of the block 4, in the direction of delivery of the paste, is located a duct 6 of an elastically deformable material, which air-tight connects the block 4 to another similar block 7, attached to the enclosure 1 and provided with an inner passage 8, shown in dotted lines. To the bottom portion of the block 7 there is sealingly attached the delivery mouth 9, which is better visible in FIGS. 4 and 5. Said mouth or outlet advantageously consists of a hose or flexible tube length, one end whereof is air-tight connected to the block 7 (e.g., in the same manner as described with reference to the ends of the flexible duct 6), and the other accomodates a small reed 10 transversally to the duct 6 direction, said reed having a length substantially corresponding to or slightly greater than one half the circumference of the tube constituting the mouth, as shown in FIG. 5, such that under normal conditions the free end of the delivery tube is stretched all around the reed and practically closed to an air-tight seal, the inner walls of the delivery tube being held taut against the two larger sides of the reed. However, the resiliency of the tube 9 allows the delivery mouth to be open under pressure from the paste material. The axis of the delivery tube extends normal to the axis of the flexible duct 6.

Proximate to the delivery mouth 9, the enclosure or housing 1 has an opening 11 of a substantially larger size than the maximum cross sectional dimension of an ordinary toothbrush 12 or other receiving member whereon the toothpaste or paste-like material being dispensed by the device is to be spread. In alignment with said opening 11 is located a movable carriage 13, running along guides 14 which extend parallel to the flexible duct 6 and are attached to the sidewalls of the enclosure 1. The guides 14 enter corresponding longitudinal slots or grooves 15 in the carriage itself. Against the side of the carriage 13 remote from the one facing the delivery mouth 9 a resilient means in form of a spring 16 is active, one end whereof is, for example, received in a cylindrical seat 17 of the carriage 13, and the other end whereof is freely arranged around a cylindrical stem 18 which is rigid with the enclosure 1 and oriented towards the carriage 13. In its rest or inoperative position, the carriage has its front face located close to the delivery mouth 9, as shown in FIG. 1, and is held in this position, for example, by a retainer 19. Above the carriage 13 is arranged a pressure or squeezing member 20, one end whereof is freely journaled to corresponding ears 21 of the carriage 13, along an axis perpendicular to the axis of the duct 6, while its other end is in turn provided with two spaced arms 22 wherein a pin 23 is inserted which extends in a transversal direction with respect to the longitudinal extension of the duct 6. A squeezing roll or roller 24 is mounted for rotation onto the pin 23. The member 20 is placed under the action of a leaf spring 25, located between the top surface of the carriage 13 and the member 20, such as to hold, in the rest condition, the roller 24 in light pressure contact with the flexible duct 6, as shown in FIG. 1.

The pin 23 has a length approximately equal to the inner distance between the sidewalls 1*a* of the enclosure 1. Two cams 26 are arranged in the path of the squeezing member 20 internally on these walls, one each, and have a substantially parallelogram contour or profile, the cams being substantially flat pieces secured to the walls or formed integrally therewith. The larger sides of the substantially parallelogram-like contour extend parallel to the longitudinal direction of the flexile tube or hose 6. One of the larger sides of each cam 26 is at a level such that when the ends of the pin 23 engage that side, the roller 24 does not contact the flexible tube 6, while the opposite larger side of each cam is at a level such as to squeeze the flexible tube 6 virtually along its entire transversal dimension. The length of the cams 26 in the direction of movement of the carriage 13 is commensured to the amount of paste to be dispensed each time, as will be apparent hereinafter.

Advantageously, the enclosure 1 may also include a shaped lower portion or bottom portion 1*b*, provided with a lower opening 27, wherethrough the body of the toothbrush with its bristles can be inserted such as to be retained inside the enclosure 1, thus avoiding contamination. During the insertion, on contacting the edge of the opening 27, the brush can advantageously undergo a wringing action which will keep it dry. It is preferable to arrange shims 28 such as to hold the brush oriented with its handle toward the front portion of the enclosure 1, thereby it can easily be grasped when the enclosure is attached, by appropriate means, to a vertical wall in the position shown in FIG. 1.

For a discussion of the use and operation of the device according to this invention, reference will be made in particular to FIGS. 1, *6a*, *6b*, *6c*.

In its rest or inoperative condition, as mentioned, the device is in the position shown in FIG. 1. To get a dose or metered amount of toothpaste or other paste-like material onto a toothbrush or similar instrument, it is sufficient that the brush be inserted through the opening 11 with its bristles facing the delivery mouth 9, thereafter the brush is pushed as far as it will go with the carriage 13 against the bias of the spring 16, and then gradually released. As the brush exits the opening 11, it will carry a layer of paste added thereto. In fact, by moving the carriage 13 by means of the brush in the direction indicated by the arrow in FIG. *6a*, i.e. against the bias of the spring 16, it first happens that the ends of the pin 23 meet the sloping front sides of the cams 26, thus moving the pressure roller 24 progressively away from the flexible duct 6, against the action of the leaf spring 25.

Thereafter, as the displacement of the brush and carriage progresses, the roller 24 is held removed from the duct 6 owing to the presence of the lower sides of the cams 26, as shown in that same FIG. *6a*.

As the ends of the pin 23 move, under the pushing action of the brush, past and over the lower rear apexes of the cams 26, the squeezing member 20 is sharply lifted by the leaf spring 25 to bring the roller 24 in contact with the flexible duct 6 (FIG. *6b*). Upon the brush 12 being released gradually, the carriage 13, being urged by the spring 16, moves back toward its rest position, but the ends of the pin 23 are now compelled to follow at first the top portion of the sloping rear sides of the cams 26, and then the larger top sides thereof, thereby there occurs an initial increasing compression of the duct 6 by the roller 24, followed by a progressive compression of the duct in the return direction of the carriage. Such an overall compression results in the displacement to and out of the delivery mouth 9 of the mass of paste contained in the duct 6 downstream of the roller 24. Since at the same time the brush 12 is moving under the delivery mouth 9, it is covered with a layer of paste exiting it, as shown in FIG. *6c*. It should be noted that during this step or phase, the duct 6 cannot undergo deformation at its upper portion, it being virtually in contact with the surface 1*c* of the enclosure 1, thereby dispensing of the paste in the correct amount is ensured. Simultaneously, upstream of the roller 24, a vacuum is created in the duct 6 which sucks up into the duct a fresh charge of paste, substantially equal to the dispensed amount. Delivery stops as the carriage 13 reaches its rest position (FIG. 1), wherein the roller 24 is no longer pressing on the duct 6, the ends of the pin 23 being by now released from the cams 26.

It will be quickly recognized that, by modifying the lengths of the cams 26, i.e. and in essence the position of the lower rear corner of the cams, it becomes possible to vary the amount of paste being dispensed, and, for example, toothpaste dispensing devices may be produced separately for adults and children.

Advantageously, the transversally elongated opening of the delivery mouth 9 favors a uniformly spread layer of paste along the width of the brush 12.

It will be apparent from the foregoing how the dispensing device according to this invention affords in an extremely simple manner the laying of a carefully metered amount of toothpaste or the like onto a toothbrush or the like. This device is advantageously based on a controlled and metered suction of the toothpaste tube contents, rather than on the compression or squeezing of the toothpaste tube, as is ordinarily done manually and as it would appear obvious even with the addition of a mechanical device. This very fact not only eliminates brute force action on the tube, but also ensures constant dispensed amounts. The sealing closure of the delivery duct further ensures a reliable device.

The above-described device fully achieves the invention objects as cited in the preamble. It should be further added that the device described hereinabove lends itself to be quickly installed anywhere, and is also easy to carry about and use as such.

Figure 8:
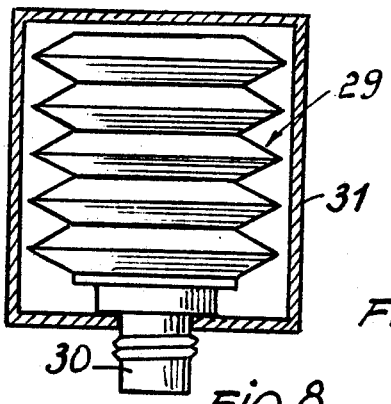
FIG. 8 shows a container which is specially suited to application of the device according to this invention.
Figure 3:
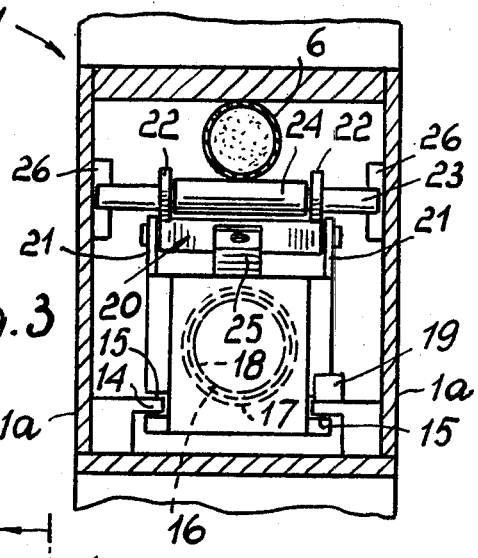
FIG. 3 is a sectional view taken along the line III—III of FIG. 1, shown on an enlarged scale.

The invention just described is susceptible to many modifications and variations, all of which fall within the scope of the instant inventive concept. Thus, for example, the toothpaste could be contained in a compartment within the enclosure of the device itself, as indicated in FIG. 7, to produce a disposable dispensing unit the cost whereof, thanks to its simple construction, could be only marginally higher than that of an ordinary toothpaste tube, for a given amount of paste contents. The toothpaste, or the like material, however, could also be contained in a special container, to be removably attached to the enclosure 1 at the block 3. A preferred example is shown in FIG. 8, where the container 29 is of accordion-like shape and has preferably a circular cross section. It is provided with a threaded neck 30 intended to be threaded onto the block 3, or alternatively, with other means for removably attaching it to the block 3. The container 29 is preferably of a plastic material and may advantageously be enclosed in a box 31. Such a container has been found to be particular suitable for the purpose, since it permits a complete emptying of the contents under the suction effect of the dispensing device. In fact, as the delivery and emptying of the accordion-like container is carried on, the container becomes increasingly smaller in an axial direction, while the material contained at the edge areas is gradually pushed toward the center of the container, i.e, to an ideal position for being sucked up. The dispensing device described hereinabove could also do without its lower portion 1*b*. Furthermore, the carriage 13 could also include in its front surface a small recess matching the rounded tip of the brush 12, such as to facilitate the engagement of the latter with the carriage 13. Naturally, the toothpaste tube 2 could also be arranged at the lower portion of the enclosure 1, dispensing being independent of the tube orientation. The roller 24 could be omitted or replaced with an equivalent means. While reference has been made thus far almost exclusively to toothpaste, it will be apparent that the device according to this invention is also useful for any paste-like or slurry material to be spread onto a means, e.g. shoe polish.

In practicing the invention, the forms, dimensions and materials used may be any ones to suit individual requirements.

I claim:

1. A dispensing device for paste-like material, particularly toothpaste, comprising a housing, an opening in said housing, a container of said material secured to said housing, a delivery mouth proximate to said opening for dispensing a controlled amount of said material on a receiving member like a toothbrush when inserted into said housing through said opening, an elastically deformable duct between said container and said delivery mouth in air-tight connection therewith, a carriage slidable substantially parallel to said duct and operable by said receiving member to move substantially parallel to said duct together with said receiving member when said receiving member is introduced into said housing through said opening, a squeezing member journaled to said carriage and resiliently urged toward said duct, cams arranged in the path of said squeezing member for causing said squeezing member to move spaced from said duct when said receiving member is moved within said housing in engagement with said carriage away from said opening and to progressively squeeze said duct toward said delivery mouth when said receiving member is moved within said housing together with said carriage toward said opening to dispense a controlled amount of said material onto said receiving member while simultaneously sucking a substantially equal amount into said duct from said container, and resilient means for urging said carriage toward said delivery mouth during delivery of said material.

2. A device as claimed in claim 1, wherein said squeezing member comprises a pair of arms each having one end journaled to said carriage and another end rotatably supporting a squeezing roll, and wherein said cams each have a substantially parallelogram-like profile having two parallel larger sides and two parallel smaller sides, said another end of each of said arms carrying a pin having ends adapted to engage each with one of said cams, one of said larger sides of said profile being arranged at a level such as to hold said other end removed from said duct and the other of said larger sides of said profile being arranged at a level such as to urge said other end with said squeezing roll against said duct to squeeze it.

3. A device as claimed in claim 1, wherein said delivery mouth comprises a length of flexible tube extending in a direction perpendicular to the direction of said duct, said length of flexible tube having one end air-tight connected to said duct and another end housing a small reed arranged transverse to said other end, said other end having a circumferential extent and said reed having a length slightly greater than one half of said circumferential extent such as to stretch said other end all around said small reed in order to provide an air-tight seal.

* * * * *